US006577046B2

(12) United States Patent
Peeters et al.

(10) Patent No.: US 6,577,046 B2
(45) Date of Patent: Jun. 10, 2003

(54) ELECTRIC DISCHARGE LAMP WITH FORKED CONTACTS

(75) Inventors: Nicolas Gerardus Antonius Peeters, Eindhoven (NL); Hendrikus Albertus Maria Van Dulmen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 141 days.

(21) Appl. No.: 09/811,636

(22) Filed: Mar. 19, 2001

(65) Prior Publication Data

US 2001/0030497 A1 Oct. 18, 2001

(30) Foreign Application Priority Data

Mar. 21, 2000 (EP) ..... 00201026

(51) Int. Cl.[7] ..... H01J 5/48; H01J 5/50

(52) U.S. Cl. ..... 313/318.01; 313/318.03; 313/318.05; 313/315

(58) Field of Search ..... 313/318.01–318.12; 439/611–619, 36, 395, 638, 639, 411; 315/56–58

(56) References Cited

U.S. PATENT DOCUMENTS 4,464,002 A * 8/1984 Suzuki et al. ..... 439/397
4,557,544 A * 12/1985 Esser ..... 439/391
4,836,800 A * 6/1989 Markwardt ..... 439/291
4,853,583 A * 8/1989 Ridders et al. ..... 313/318.02
4,862,035 A * 8/1989 Cunliffe et al. ..... 315/58
4,908,546 A * 3/1990 Shaffer et al. ..... 174/50.59
4,999,538 A * 3/1991 Lapre et al. ..... 313/318.01
5,629,581 A * 5/1997 Belle et al. ..... 313/318.12
5,765,941 A * 6/1998 Vest ..... 313/50
6,297,585 B1 * 10/2001 Tashiro et al. ..... 313/318.02

FOREIGN PATENT DOCUMENTS

DE 3333294 A1 6/1985 ..... F21V/19/00

* cited by examiner

*Primary Examiner*—Nimeshkumar D. Patel
*Assistant Examiner*—German Colón
(74) *Attorney, Agent, or Firm*—Frank Keegan

(57) ABSTRACT

The electric discharge lamp comprises a shell (1) having an axis (2), which shell accommodates a starter (3) and pin-shaped contacts (4) extending in an axial direction. A cover (27), which is coupled to a discharge vessel (20), is attached to the shell (1). Pairs (23) of current conductors (24) emanate from the discharge vessel (20). The conductors (24) of each pair (23) are clamped, in a direction transverse to the axis (2), by first and second (6) forked contact elements, which are secured in the shell (1) and are directed towards the cover (27). The lamp is of a simple construction, which can be readily produced.

8 Claims, 7 Drawing Sheets

ELECTRIC DISCHARGE LAMP WITH FORKED CONTACTS

BACKGROUND OF THE INVENTION

1. Field of the Invention

The invention relates to an electric discharge lamp comprising:

a shell having an axis, which shell accommodates a starter and is provided, on an outside, with electric contacts which are to be connected to a power supply;

a hermetically sealed discharge vessel comprising electrodes in end portions, which electrodes are each connected to a pair of current conductors which issue from the relevant end portion to the exterior;

a cover which is fixed on the shell in a direction transverse to the axis, which cover is rigidly attached to the discharge vessel, the pairs of current conductors each being connected to the starter and to a respective electric contact.

2. Description of Related Art

Such a discharge lamp is disclosed in DE-A 33 33 294.

The known lamp comprises a shell which accommodates, apart from the starter for igniting the lamp, a ballast to limit the current flowing through the lamp during operation. The contacts of the shell are situated at an Edison-cap, i.e. a screw cap. The shell of the cap serves as a first contact, and a bottom of the screw cap which is isolated from the shell of the cap serves as a second contact. The ballast and the Edison-cap enable the lamp to be directly connected to the electric mains.

The discharge vessel and the cover of the known lamp are detachably secured to the shell. For this purpose, the discharge vessel is specially provided with axially directed, rigid pins, which come into contact with the ballast when the cover is placed on the shell.

A drawback of the known lamp resides in that the shell comprises a ballast, leading to much assembly work in the manufacture of the lamp and causing the lamp to be bulky. Another drawback of the lamp resides in that special, unusual, rigid pins must be provided at the discharge vessel. Yet another drawback resides in that the discharge vessel with the cover can be detached from the shell, so that arrangements must be made to ensure that all live parts in the shell are inaccessible to the user.

BRIEF SUMMARY OF THE INVENTION

It is an object of the invention to provide an electric discharge lamp of the type described in the opening paragraph, the construction of which is simple, safe and readily reproducible.

In accordance with the invention, this object is achieved in that, for each pair of current conductors, a first and a second forked contact element facing the cover is attached in the shell, in which contact element a respective current conductor is tightly and inextricably fixed so as to extend transversely to the axis, and the contacts at the shell are pin-shaped and extend along the axis.

Owing to the pin-shaped contacts, the lamp cannot be directly connected, via a screw socket or bayonet socket, to the electric mains, but instead is applied using an external ballast which, for example, is accommodated in a luminaire. As a result, the construction of the lamp is comparatively simple, and the lamp is not very bulky.

In the assembly process of the lamp, the contact elements enable the shell and the cover with the discharge vessel to be united simply by pressing the shell and the cover against each other, and to simultaneously form electric connections, via the contact elements, between the current conductors on the one hand and the electric contacts on the other hand. This also enables the discharge vessel to be secured to the cover before the discharge vessel is electrically connected to the shell. Thermal processes, such as soldering electric connections and, for example, cementing for connecting the shell and the discharge vessel to each other, can thus be avoided in the final step in the manufacture of the lamp.

The forked contact elements are known per se as "piercing contacts". These forked contact elements comprise a metal plate, an edge of which is provided with a slit having a narrowing entry. A metal conductor, for example a wire, may be provided in the entry of the slit so as to extend transversely to the plate, whereafter said conductor is laterally pressed into the slit. The slit and the wire are dimensioned so that the contact element forms grooves in the conductor, resulting in a close and mechanically strong contact. If the connection is inaccessible to tools, the connection generally cannot be interrupted in a non-destructive manner and hence is inextricable.

In a favorable embodiment, the starter has current-supply wires, and the first contact elements comprise a forked portion, wherein the current-supply wires are tightly accommodated. This embodiment has the advantage that, for example, soldered joints between the starter and the contact elements are avoided.

It is possible that the contact elements were present when the shell was manufactured, as a result of which they are anchored in the shell. Advantageously, however, the shell has seatings and the contact elements are tightly accommodated in a respective seating. This has the advantage, inter alia, that the shell can be manufactured in a simpler mold.

Another advantage of said embodiment resides in that the forked portion accommodating the current-supply wires may be directed away from the cover. This has the advantage that if the starter is arranged in the shell prior to the contact elements, the electric connection between the contact elements and the starter is formed at the same time.

It is desirable for the lamp to comprise an anti-hum capacitor. In a modification, this capacitor having conducting wires is accommodated in the shell, and the first contact elements comprise a second forked portion facing away from the cover, in which forked portion the conducting wires are tightly accommodated. In the manufacture of this modification, the electric connections of the starter and the capacitor are simultaneously formed when the contact elements are provided.

In a favorable embodiment, the second contact elements are integral with the electric contacts. This embodiment has the advantage that making electric connections between the contacts and the second contact elements can be dispensed with.

The shell and the cover may be, for example, clamped together. It is attractive, however, if they are permanently interconnected. They may be attached to each other, for example, by local fusion or bonding using an adhesive. In an advantageous embodiment, however, the cover and the shell are secured to each other by means of a click-connection, in particular a concealed, i.e. invisible and inaccessible, click connection. In this case, the shell and the cover are interconnected in an assembly operation, i.e. without using thermal or other processes.

The discharge vessel may comprise, for example, a curved tube or various series-connected, curved or straight tubular portions. The discharge vessel may be connected to the cover by means of, for example, a cement or an adhesive, such as a UV-curing adhesive.

The contact elements may be made from, for example, phosphor bronze or stainless steel. The shell and the cover may be manufactured from a synthetic resin, for example a thermoplastic, such as polybutylene terephtalate.

These and other aspects of the invention will be apparent from and elucidated with reference to the embodiment(s) described hereinafter.

DETAILED DESCRIPTION OF THE INVENTION

Figure 1:
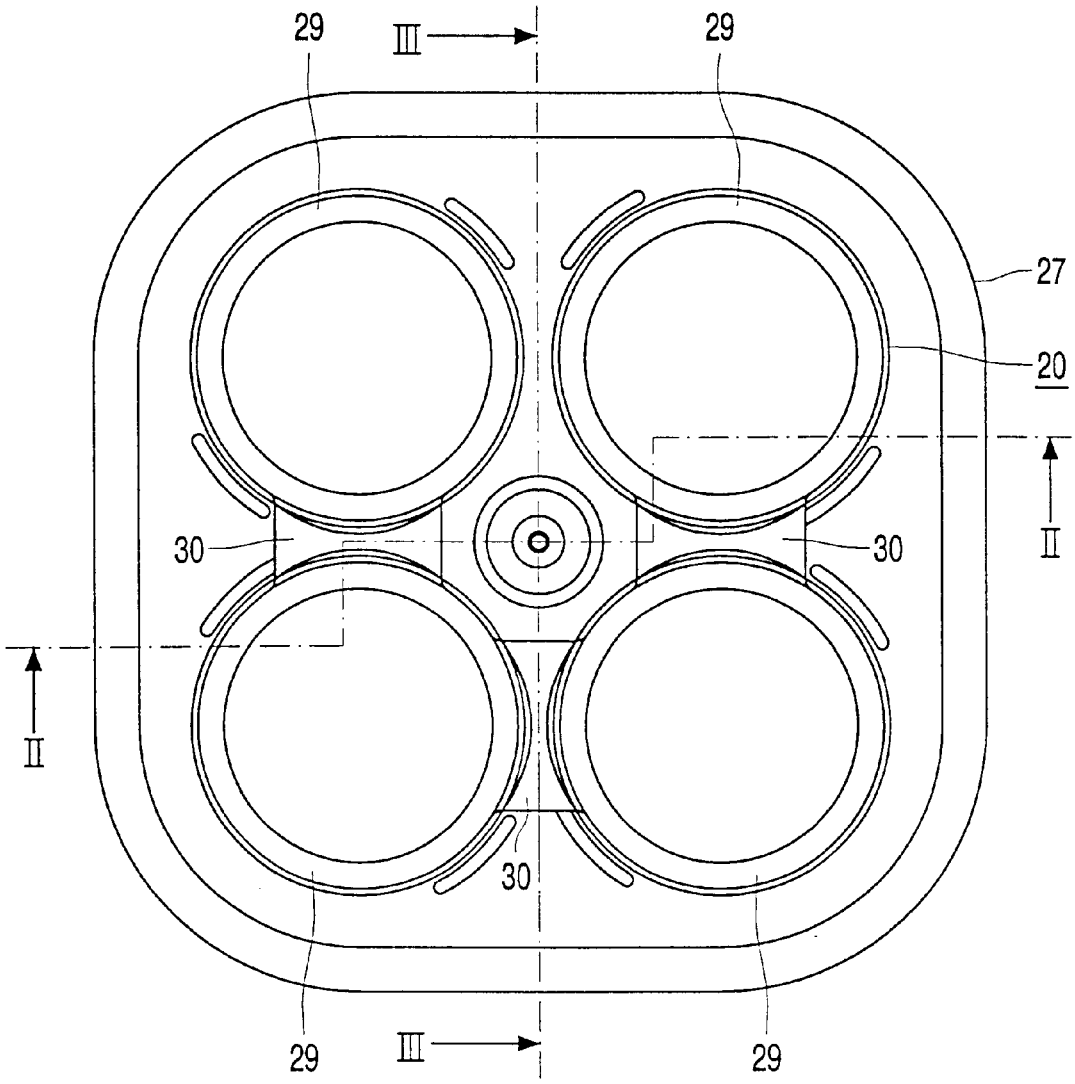
FIG. 1 is a plan view of the lamp.

The figs. are purely diagrammatic and not drawn to scale. Particularly for clarity, some dimensions are exaggerated strongly. In the figs., like reference numerals refer to like parts whenever possible.

FIG. 1 shows the discharge vessel 20 of the lamp, which discharge vessel is secured in the cover 27. In the embodiment shown, the discharge vessel 20 has four straight, tubular portions 29, which are connected in series by bridges 30 (cf. FIGS. 2 and 3). The lamp is a low-pressure mercury vapor fluorescent lamp.

Figure 2:
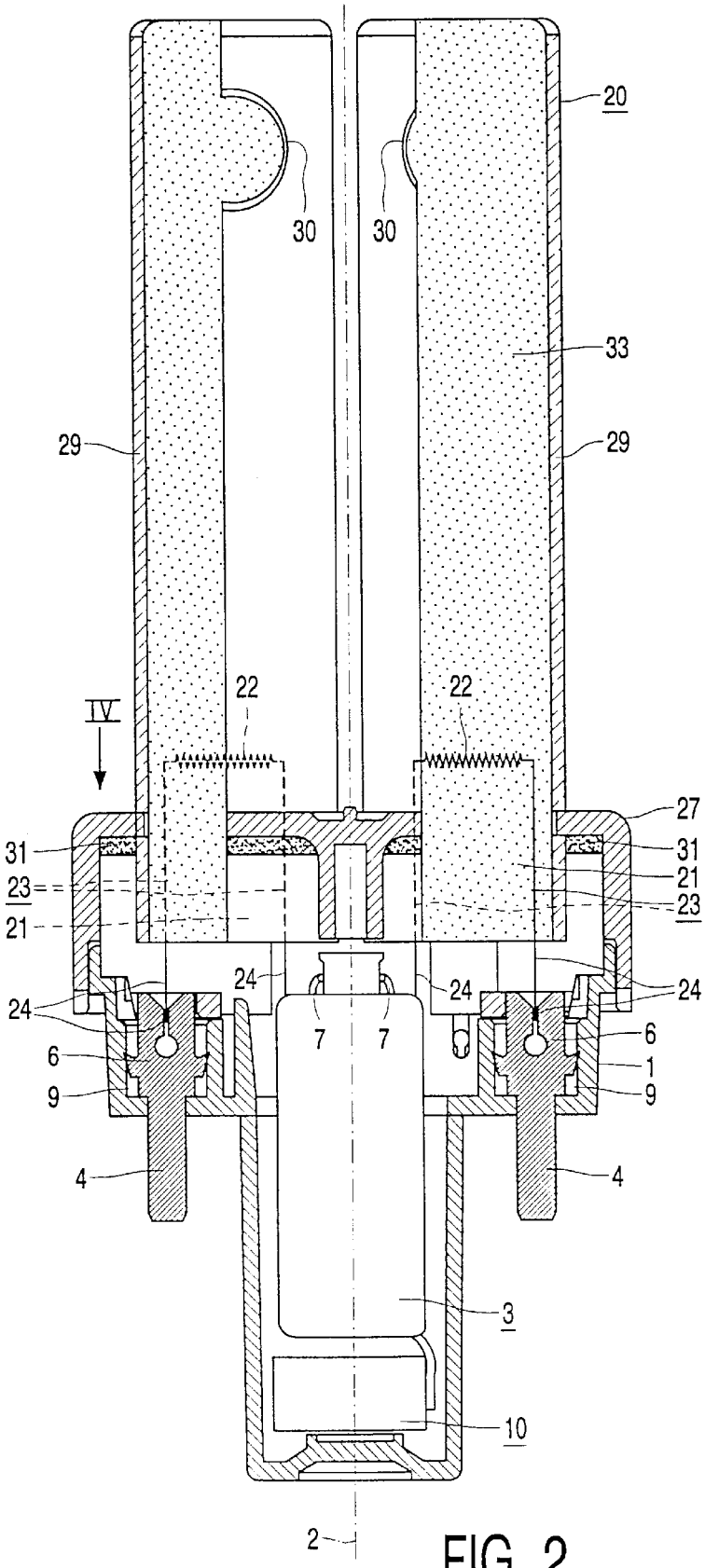
FIG. 2 is an axial, cross-sectional view taken on the line II—II in FIG. 1.
Figure 3:
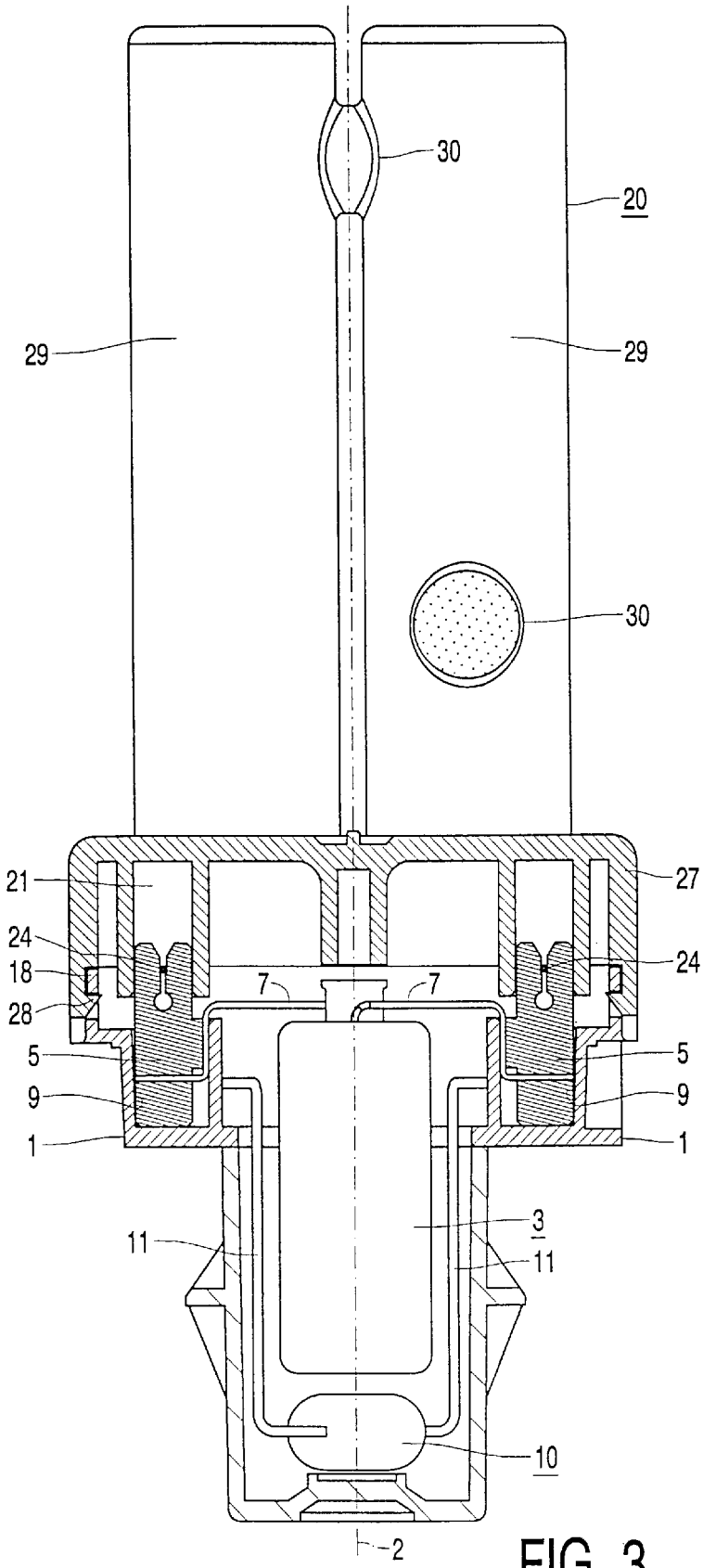
FIG. 3 is an axial, cross-sectional view taken on the line III—III in FIG. 1.

In FIG. 2 and FIG. 3, the electric discharge lamp comprises a shell 1 with an axis 2. The shell 1 accommodates a starter 3. The shell 1 is provided, on an outside, with electric contacts 4, which are to be connected to a power supply. The hermetically sealed discharge vessel 20 comprises, in end portions 21, see FIG. 2, electrodes 22 which are each connected to a pair 23 of current conductors 24, which issue from the relevant end portion 21 to the exterior. A cover 27 is secured on the shell 1, in a direction transverse to the axis 2. The cover 27 is rigidly attached to the discharge vessel 20, in this embodiment by means of cement 31. The discharge vessel 20 is covered with fluorescent powder 33. The pairs 23 of current conductors 24 are each connected to the starter 3 and to a respective electric contact 4, also see FIG. 8.

For each pair 23 of current conductors 24, a first forked contact element 5, see FIG. 3, and a second forked contact element 6 directed towards the cover 27, see FIG. 2, are secured in the shell 1, in which contact elements, a respective current conductor 24 is tightly and inextricably fixed transverse to the axis 2. The contacts 4 at the shell 1 are pin-shaped and extend along the axis 2. In this embodiment, the shell 1 and the cover 27 are made from polybutylene terephtalate, and the contact elements 5, 6 are made from phosphor bronze.

FIG. 2 shows that the second contact elements 6, in the embodiment shown, are integral with the electric contacts 4. Apart from the starter 3, the shell 1 accommodates an anti-hum capacitor 10, which electrically shunts the starter 3.

As shown in FIGS. 2 and 3, the shell 1 includes seatings 9. The contact elements 5, 6 are tightly accommodated in a respective seating 9.

Figure 4:
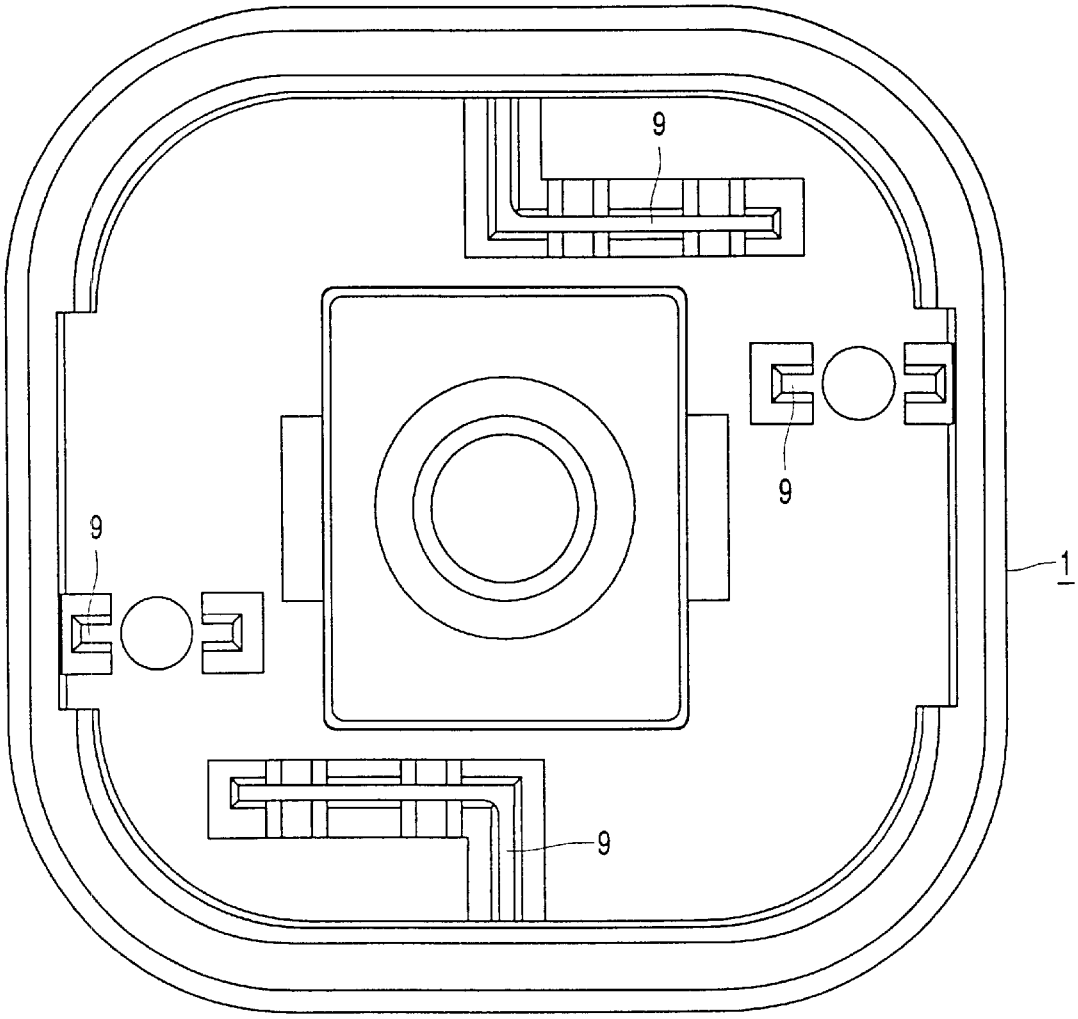
FIG. 4 is a view of the empty shell according to IV in FIG. 2.

FIG. 4 shows, in the interior view of the shell 1, right-angled seatings 9 for the first contact elements 5 and straight seatings 9 for the second contact elements 6. The right-angled seatings 9 are used to tightly accommodate the first contact elements 5 of FIGS. 5, 6 and 7.

Figure 5:
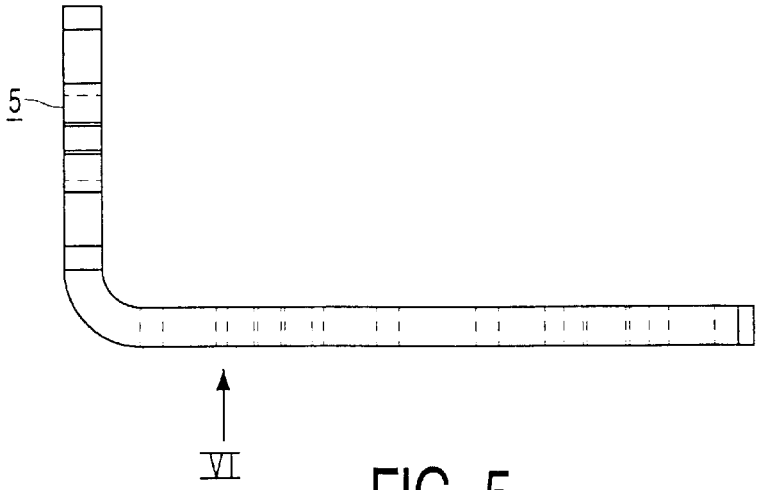
FIG. 5 is a plan view of a first contact element.
Figure 6:
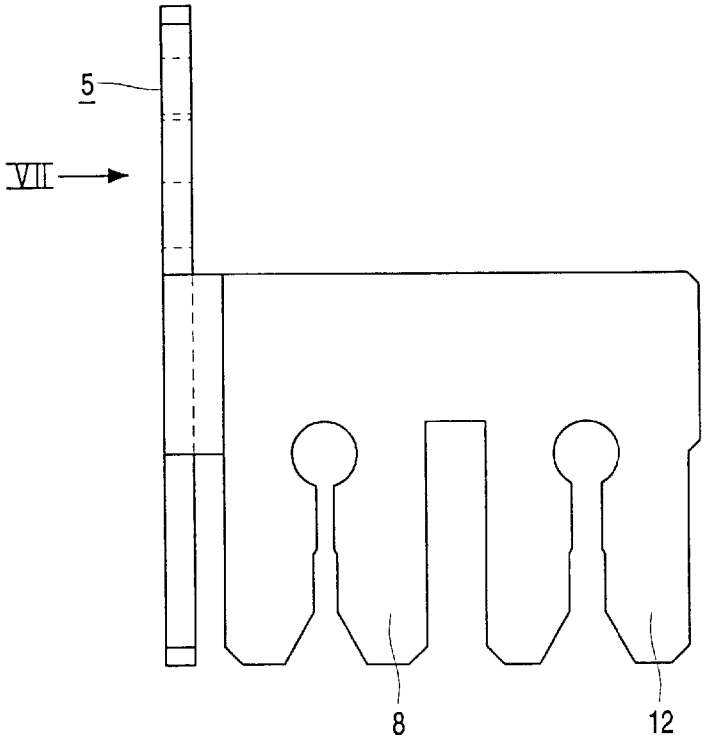
FIG. 6 is a view of the first contact element according to VI in FIG. 5.
Figure 7:
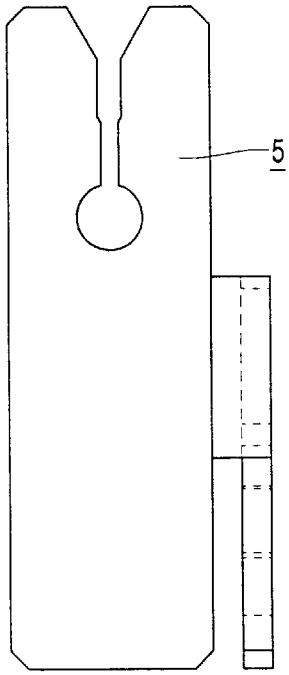
FIG. 7 is a view of the first contact element according to VII in FIG. 6.

FIG. 5 shows the first contact elements 5 in the position from which it can be accommodated in the seating 9 at the top of FIG. 4. In this position, the first, forked contact element 5, see FIGS. 6 and 7, is directed towards the cover 27, see FIGS. 2 and 3. The first contact element includes a forked portion 8, see FIG. 6, which is directed away from the cover 27. FIG. 6 also shows a second forked portion 27, which is also directed away from the cover 27.

Figure 8:
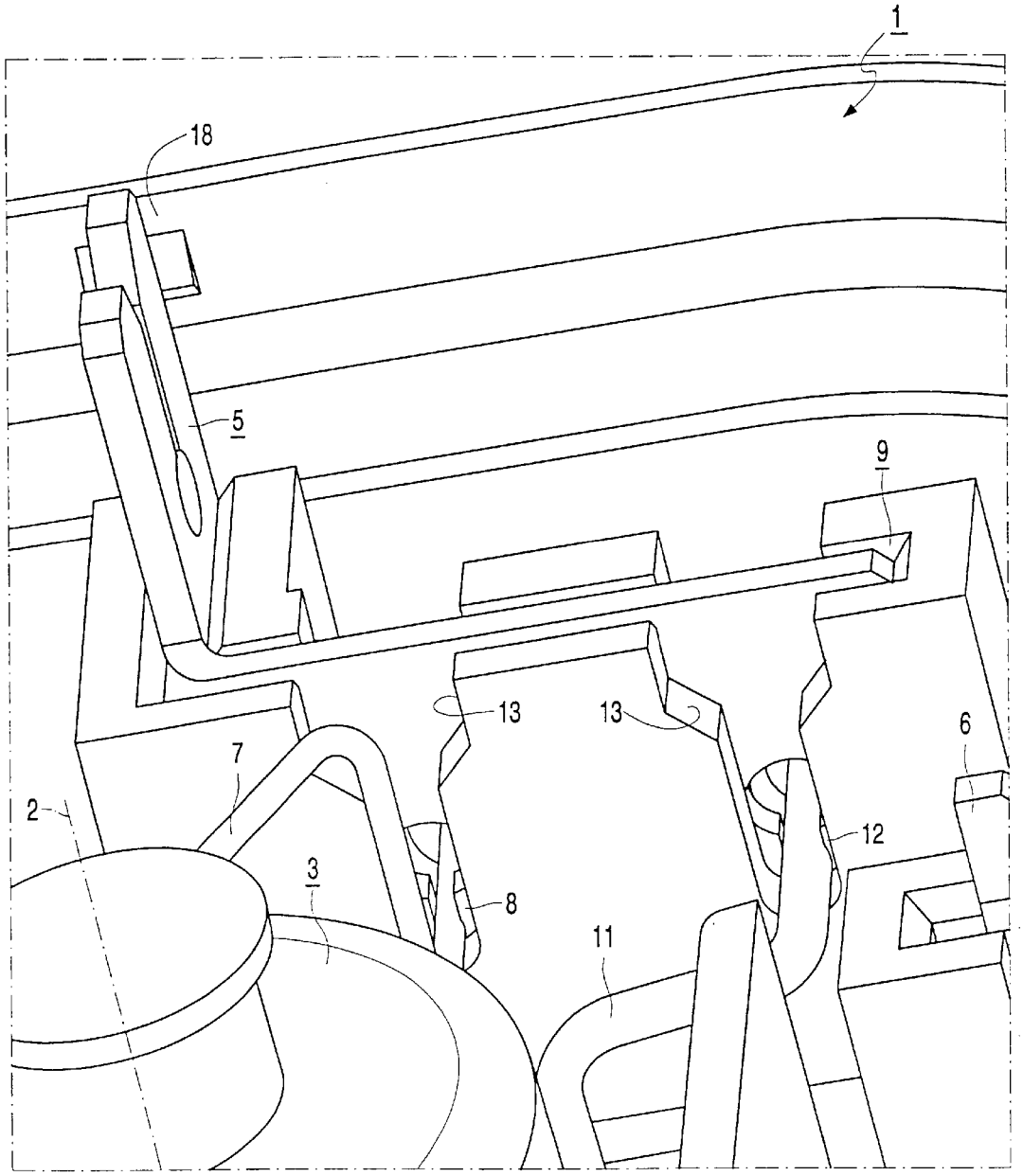
FIG. 8 is a perspective view of a detail shown in FIG. 4 after mounting steps.

The starter 3 is provided with current-supply wires 7, see FIGS. 2, 3 and 8, which are tightly accommodated in the relevant forked portion 8.

Shell 1 also accommodates a capacitor 10, see FIGS. 2 and 3, which has conducting wires 11, which wires 11 are tightly accommodated in the second forked portion 12, which faces away from the cover 27, of the first contact elements 5.

The shell 1 and the cover 27 are inextricably connected to each other, in FIG. 3, by a click connection 18, 28.

In FIG. 8, the starter 3 is provided in the shell 1, a current-supply wire 7 of said starter being visible. Also a conducting wire 11 of the capacitor 10 is visible, which capacitor is shown in FIGS. 2 and 3. The current-supply wire 7 and the conducting wire 11 are each arranged in a recess 13 of the seating 9, and extend transversely across the seating. Subsequently, the first contact element 5 is provided in the seating 9, whereby the forked portion 8 facing away from the cover, referenced 27 in FIGS. 2 and 3, and the second forked portion 12 facing away from the cover tightly accommodate, respectively, the current supply wire 7 and the conducting wire 11, in a direction transverse to the axis 2. The first forked contact element 5 is directed towards the cover and ready to tightly accommodate a current conductor 24 of the discharge vessel 20, see FIGS. 2 and 3, in such a way that said current conductor 24 extends transversely to the axis 2. If the other first contact element 5 is provided correspondingly, and if the second contact elements 6 are provided, the shell 1 with its contents is ready to be united with the cover 27 and the discharge vessel 20. The contents of the shell 1 is provided entirely by assembly operations, i.e. without thermal or other processes.

Figure 9:
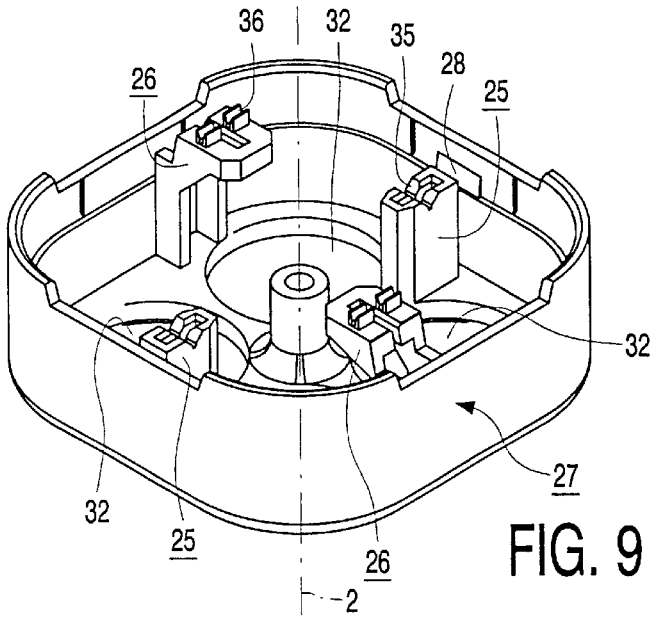
FIG. 9 is a perspective view of the inside of the cover shown in FIG. 1, and FIG. 10 diagrammatically shows the wiring of the lamp with the contact elements.

In FIG. 9, the cover 27 has openings 32 through which the discharge vessel 20, see FIGS. 2 and 3, can project. If the discharge vessel 20 is secured in the cover 27, the current conductors 24 can each be arranged in a groove 35 of a first counterseating 25, wherein a first contact element 5 can be accommodated, for example, with clearance, and in a groove 36 of a second counterseating 26 for a second contact element 6, so as to extend transversely to the axis 2. The cover 27 and everything attached thereto is ready to be united with the shell 1, so as to form the finished lamp shown in FIG. 1. For this purpose, the cover 27 is pressed onto the shell 1, as a result of which the current conductors 24 are rigidly fixed in position by the contact elements 5, 6 in order to connect them inextricably to each other, and, in the embodiment shown, the shell 1 and the cover 27 are mechanically connected to each other by the click connection 18, 28, as shown in FIG. 3.

Figure 10:
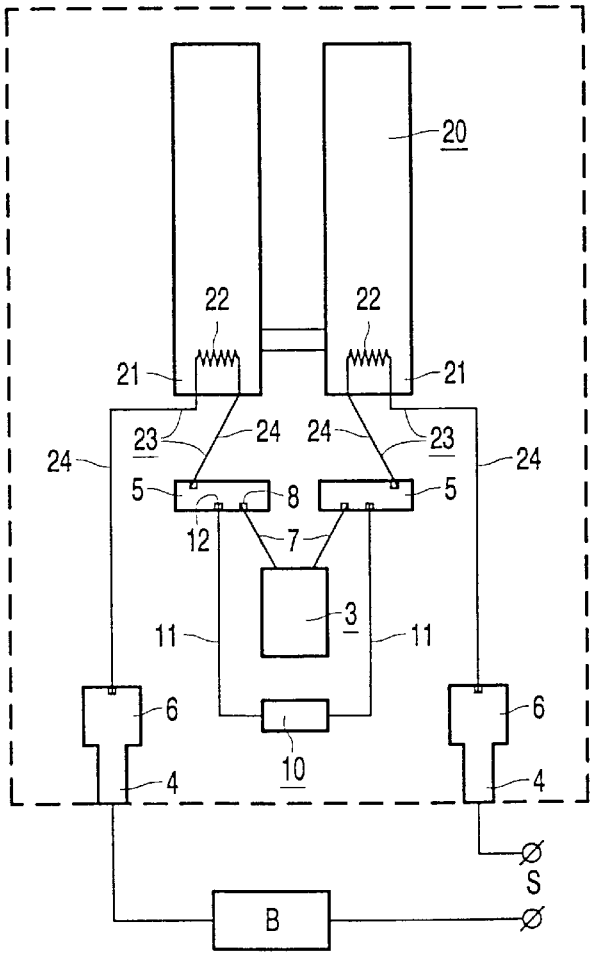

In FIG. 10, corresponding parts bear the same reference numerals as in the preceding figs. A ballast B is accommodated in an external circuit to which the electric lamp is connected by means of the pin-shaped contacts 4. In the lamp, one current conductor of each pair 23 of current conductors 24 is tightly accommodated in a second contact element 6, and the other current conductor is tightly accommodated in a first contact element 5. The starter 3 has current-supply wires 7, which are tightly accommodated in a respective first contact element 5. Also the capacitor 10 has conducting wires 11, which are tightly accommodated in a respective first contact element 5. If the lamp is energized, a glow discharge occurs in the starter 3 and current passes through the electrodes 22. Said electrodes 22 heat up, as a result of which they start emitting more readily. The starter 3 comprises a bimetal electrode, which also heats up and bends in a direction away from the second electrode, causing the glow discharge to be extinguished. A voltage pulse is then applied across the discharge vessel 20, which is capable of igniting the lamp. The voltage across the discharge vessel 20 of a burning lamp is too low to bring about another glow discharge in the starter 3 after the bimetal electrode has cooled.

It will be obvious that, within the scope of the invention, many variations are possible to those skilled in the art. The scope of protection of the invention is not limited to the examples given herein. The invention is embodied in each novel characteristic and each combination of characteristics. Reference numerals in the claims do not limit the scope of protection thereof. The use of the verb "to comprise" and its conjugations does not exclude the presence of elements other than those mentioned in the claims. The use of the article "a" or "an" in front of an element does not exclude the presence of a plurality of such elements.

What is claimed is:

1. An electric discharge lamp comprising:

a shell (1) having an axis (2), which shell (1) accommodates a starter (3) and is provided, on an outside, with electric contacts (4), which are to be connected to a power supply;

a hermetically sealed discharge vessel (20) comprising electrodes (22) in end portions (21), which electrodes are each connected to a pair (23) of current conductors (24) which issue from the relevant end portion (21) to the exterior;

a cover (27) which is fixed on the shell (1) in a direction transverse to the axis (2), which cover (27) is rigidly attached to the discharge vessel (20), the pairs (23) of current conductors (24) each being connected to the starter (3) and to a respective electric contact (4), characterized in that:

for each pair (23) of current conductors (24), first (5) and second (6) contact elements each having a forked portion facing the cover (27) are attached in the shell (1), in which each contact element a respective current conductor (24) is tightly and inextricably fixed so as to tend transversely to the axis (2), the contacts (4) at the shell (1) are pin-shaped and extend along the axis (2), and the starter (3) has current-supply wires (7), and each first contact element (5) further comprises a forked portion (8) facing away from the cover (27) wherein a current-supply wire (7) is tightly accommodated.

2. An electric discharge lamp as claimed in claim 1, characterized in that the second contact elements (6) are integral with the electric contacts (4).

3. An electric discharge lamp as claimed in claim 1, characterized in that the shell (1) comprises seatings (9), and the contact elements (5, 6) are tightly accommodated in a respective seating (9).

4. An electric discharge lamp as in claim 3 characterized in that the shell (i) accommodates a capacitor (10) having conducting wires (11), and the first contact elements (5) each comprise a second forked portion (12) facing away from the cover (27), in which forked portion a conducting wire (11) is tightly accommodated.

5. An electric discharge lamp as claimed in claim 3 wherein the forked portions of the first contact elements, which face away from the cover (8, 12) lie perpendicular to the forked portions of the first contact elements which face the cover (5).

6. An electric discharge lamp as claimed in claim 3 wherein the first and second forked contact elements (5, 6) are accommodated in respective seatings so as to lie perpendicular to each other.

7. An electric discharge lamp as claimed in claim 1, characterized in that the shell (1) and the cover (27) are inextricably connected to each other.

8. An electric discharge lamp as claimed in claim 7, characterized in that the shell (1) and the cover (27) are interconnected by means of a click connection (18, 28).

* * * * *